US008424228B2

(12) United States Patent
Toussoun et al.

(10) Patent No.: US 8,424,228 B2
(45) Date of Patent: Apr. 23, 2013

(54) LUGGAGE TAGGING SYSTEM

(76) Inventors: Aharon Toussoun, Brooklyn, NY (US); Juan Zelikovich, Caracas (VE)

( * ) Notice: Subject to any disclaimer, the term of this patent is extended or adjusted under 35 U.S.C. 154(b) by 0 days.

(21) Appl. No.: 13/331,415

(22) Filed: Dec. 20, 2011

(65) Prior Publication Data

US 2012/0260541 A1 Oct. 18, 2012

Related U.S. Application Data

(60) Provisional application No. 61/475,753, filed on Apr. 15, 2011.

(51) Int. Cl.
*A44B 11/25* (2006.01)

(52) U.S. Cl.
USPC ..... 40/6; 40/633; 24/306

(58) Field of Classification Search ..... 40/316, 40/6, 633; 24/306; 36/54
See application file for complete search history.

(56) References Cited

U.S. PATENT DOCUMENTS

| | | | | | |
|---|---|---|---|---|---|
| 2,378,755 | A * | 6/1945 | Dowling | 40/640 |
| 4,646,767 | A * | 3/1987 | Hikita | 453/58 |
| 5,459,947 | A * | 10/1995 | Lasher | 36/54 |
| D378,231 | S * | 2/1997 | Dubin | D23/252 |
| 5,671,517 | A * | 9/1997 | Gourley | 24/712.1 |
| 5,913,483 | A * | 6/1999 | Polk | 24/712.3 |
| 5,920,964 | A * | 7/1999 | Malzahn | 24/182 |
| 6,279,804 | B1 * | 8/2001 | Gregg | 224/675 |
| 6,776,528 | B2 * | 8/2004 | Wills | 383/15 |
| 6,880,364 | B1 * | 4/2005 | Vidolin et al. | 63/40 |
| D556,080 | S * | 11/2007 | Day et al. | D11/86 |

* cited by examiner

*Primary Examiner* — Casandra Davis
(74) *Attorney, Agent, or Firm* — Bernard Malina

(57) ABSTRACT

A tagging apparatus includes a luggage tag which has a flap member which is mounted on a base member. The flap member has a first end permanently connected to the base member and a second end removably connected to the base member. A space is formed between a portion of the base member and the base member enabling a flexible luggage belt to pass through the space thereby attaching the luggage tag to the luggage belt.

14 Claims, 8 Drawing Sheets

LUGGAGE TAGGING SYSTEM

RELATED APPLICATION

The present application claims priority from our provisional patent application titled Luggage Tagging System Ser. No. 61/475,753 filed on Apr. 15, 2011.

FIELD OF THE INVENTION

The present invention relates generally to the field of equipment for travelers and more particularly to a luggage tagging system.

BACKGROUND OF THE INVENTION

Currently, a large percentage of luggage used by individual travelers are of nearly identical construction and appearance. As a result these are frequent instances of confusion and errors when individual items of luggage must be retrieved from an aggregate group of similar articles of luggage. This is frequently the case in airports when luggage must be retrieved by a traveler from a luggage carousel.

Despite the attempts by many travelers to personalize their luggage by various devices such as tags or bands, there remains a need for a luggage tagging system which can be easily used by a traveler to clearly distinguish his or her luggage.

OBJECTS AND SUMMARY OF THE INVENTION

It is an object of the present invention to provide a luggage tagging system which can be easily attached to an item of luggage to easily distinguish the item of luggage from other similarly constructed items of luggage.

Another object of the present invention is to provide a luggage tagging system which incorporates a luggage belt.

Another object of the present invention is to provide a luggage tagging system which can be used with or without a luggage belt.

Another object of the present invention is to provide a luggage tagging system which can be installed after a luggage belt has been installed.

Another object of the present invention is to provide a luggage tagging system which can accommodate incorporation of various indicia.

Another object of the present invention is to provide a luggage tagging system which has a distinctive peripheral configuration.

Yet another object of the present invention is to provide a luggage tagging system which comprises a small number of component parts which can be manufactured economically in volume resulting in low unit cost and reliable operation.

In accordance with the present invention, there is provided a luggage tagging system which in a primary embodiment includes a base member and a flap member. The flap member has a first end permanently connected to the base member and a second end removably connected to the base member by a hook and loop fastener. When the second end of the flap member is connected to the base member a space is formed between the two members allowing a luggage belt to pass through the space. The base member can thus be attached to an item of luggage either before or after the luggage belt has been attached to an item of luggage.

BRIEF DESCRIPTION OF THE DRAWINGS

Additional benefits, features and aspects of the present invention will become more readily apparent from consideration from the following drawings in which.

DETAILED DESCRIPTION OF THE INVENTION

Figure 1:
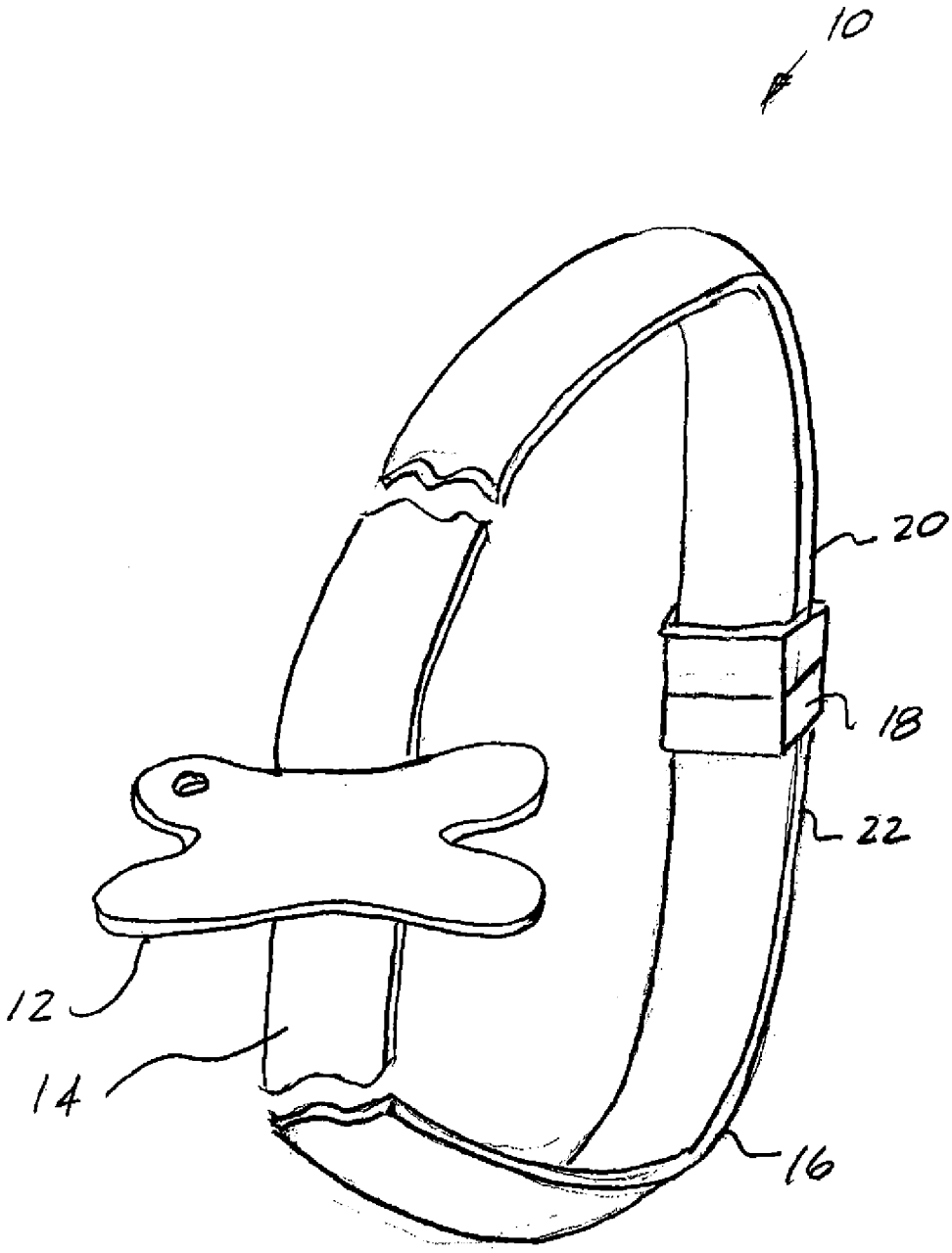
FIG. 1 is a fragmentary perspective view of a luggage tagging system made in accordance with the present invention with the system shown mounted on a luggage belt.

With reference to the drawings, there is shown in FIGS. 1-8 a luggage tagging system made in accordance with the present invention. The primary embodiment of the luggage tagging system 10 is shown in FIGS. 1-4. The luggage tagging system 10 includes a luggage tag 12 and a luggage belt 14. The luggage belt 14 comprises a flexible belt member 16 which during use encircles an item of luggage and a buckle or fastener 18 which removably connects the ends 20, 22 of the flexible belt member. The luggage belt 14 is of conventional construction and therefore has not been described in detail.

Figure 2:
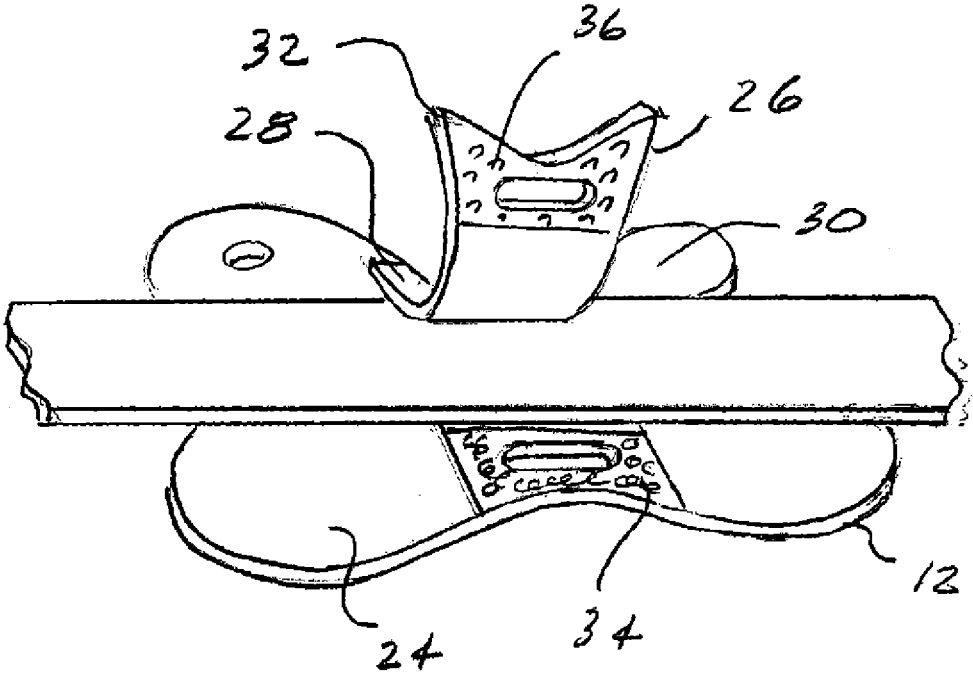
FIG. 2 is a fragmentary perspective view of a primary embodiment of the luggage tagging system of FIG. 1 showing the luggage tag in the process of being installed on a luggage belt.
Figure 3:
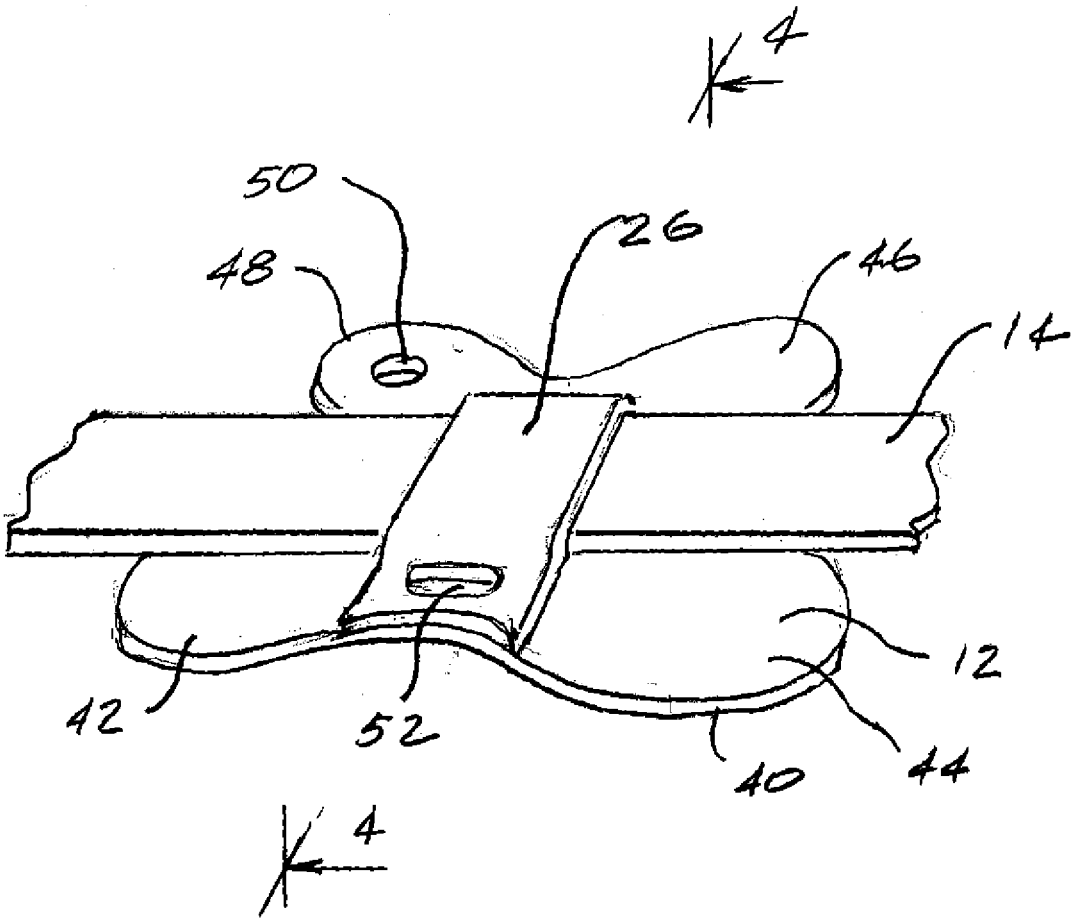
FIG. 3 is a fragmentary perspective view similar to FIG. 2 showing the luggage tag installed on a luggage belt.

The luggage tag 12 forms a key feature of the present invention. As is best shown in FIGS. 2 and 3, the luggage tag 12 includes a base member 24 and a flap member 26. The flap member 26 has a first end 28 permanently connected to the surface 30 of the base member 24 and a second end 32 which is removably connected to the surface 30 of the base member 24 by a hook and loop fastener 34,36.

Figure 4:
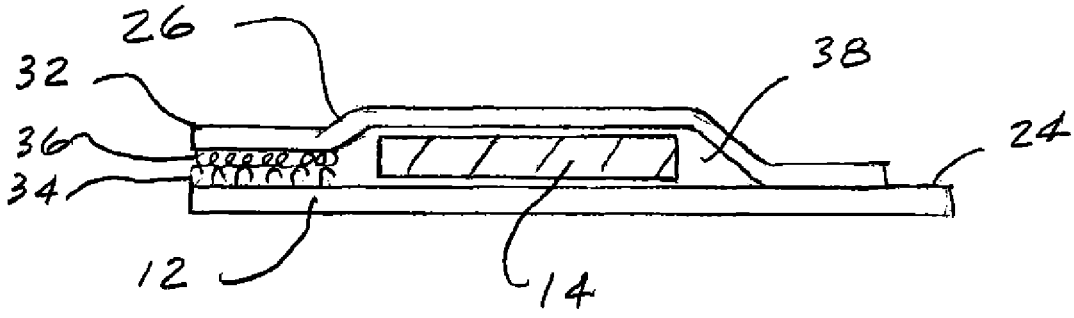
FIG. 4 is a cross-sectional view taken along the line 4-4 of FIG. 3.

When the second end of the flap member 26 is connected to the base member 24 a space 38 is formed between the flap member 26 and the base member 24 as is best shown in FIG. 4. FIG. 4 shows the luggage belt 14 passing through the space 38.

As shown in FIGS. 2-4, the flap member 26 enables a user to easily attach the luggage tag 12 to the luggage belt 14.

The peripheral edge 40 of the luggage tag 12 may have a range of circular and non-circular configurations which aid a user in identifying his or her luggage. FIG. 3 shows the peripheral edge 40 as having four lobes 42,44,46,48.

Figure 5:
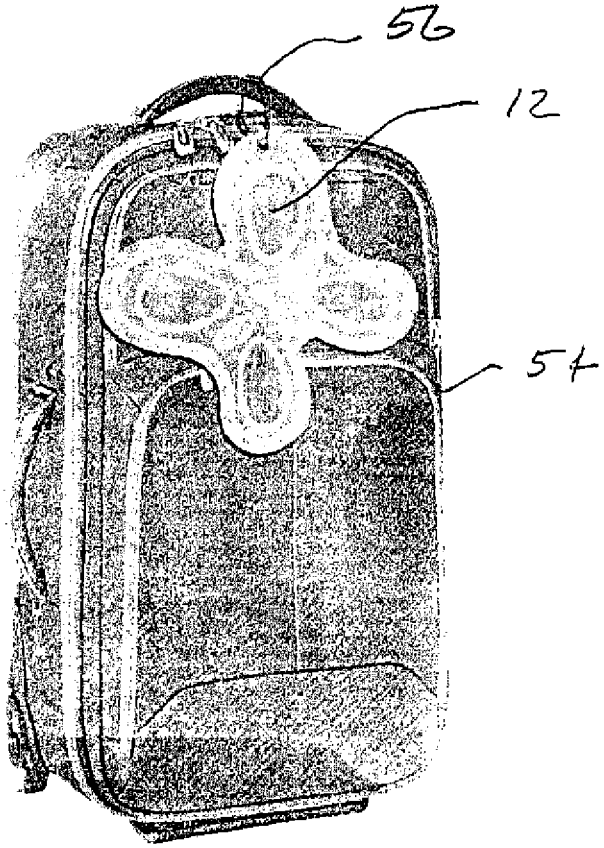
FIG. 5 is a perspective view of the luggage tagging system of FIG. 1 shown installed on an item of luggage without the use of a luggage belt.

FIGS. 3 and 5 also show the luggage tag 12 has apertures 50 and 52 for attachment to luggage 54 using a loop fastener 56 in a conventional manner without the use of a belt 14.

Figure 6:
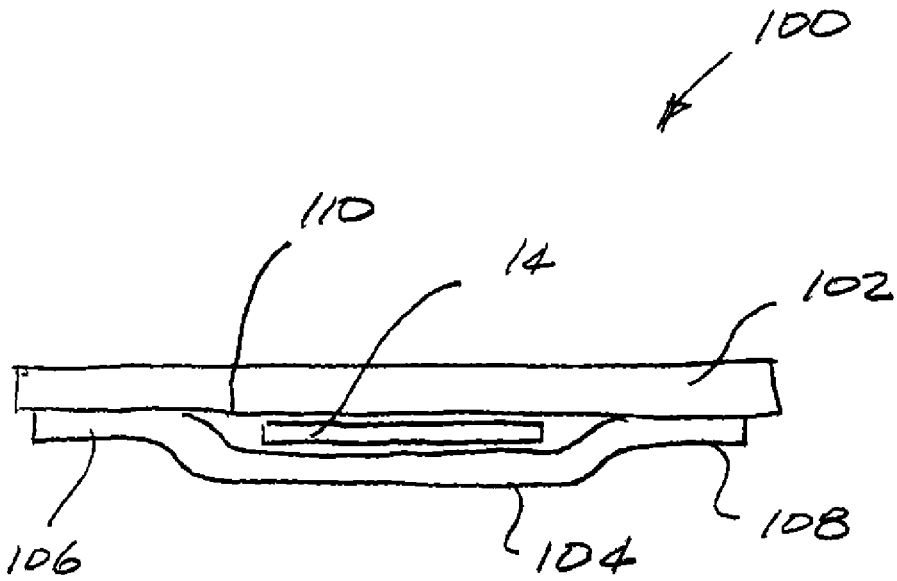
FIG. 6 is a cross-sectional view similar to FIG. 4 showing a second embodiment of the invention.

FIG. 6 shows an embodiment 100 in which the luggage tag 102 has a strap 104 with ends 106, 108 permanently attached to the surface 110 of the luggage tag 102.

Figure 7:
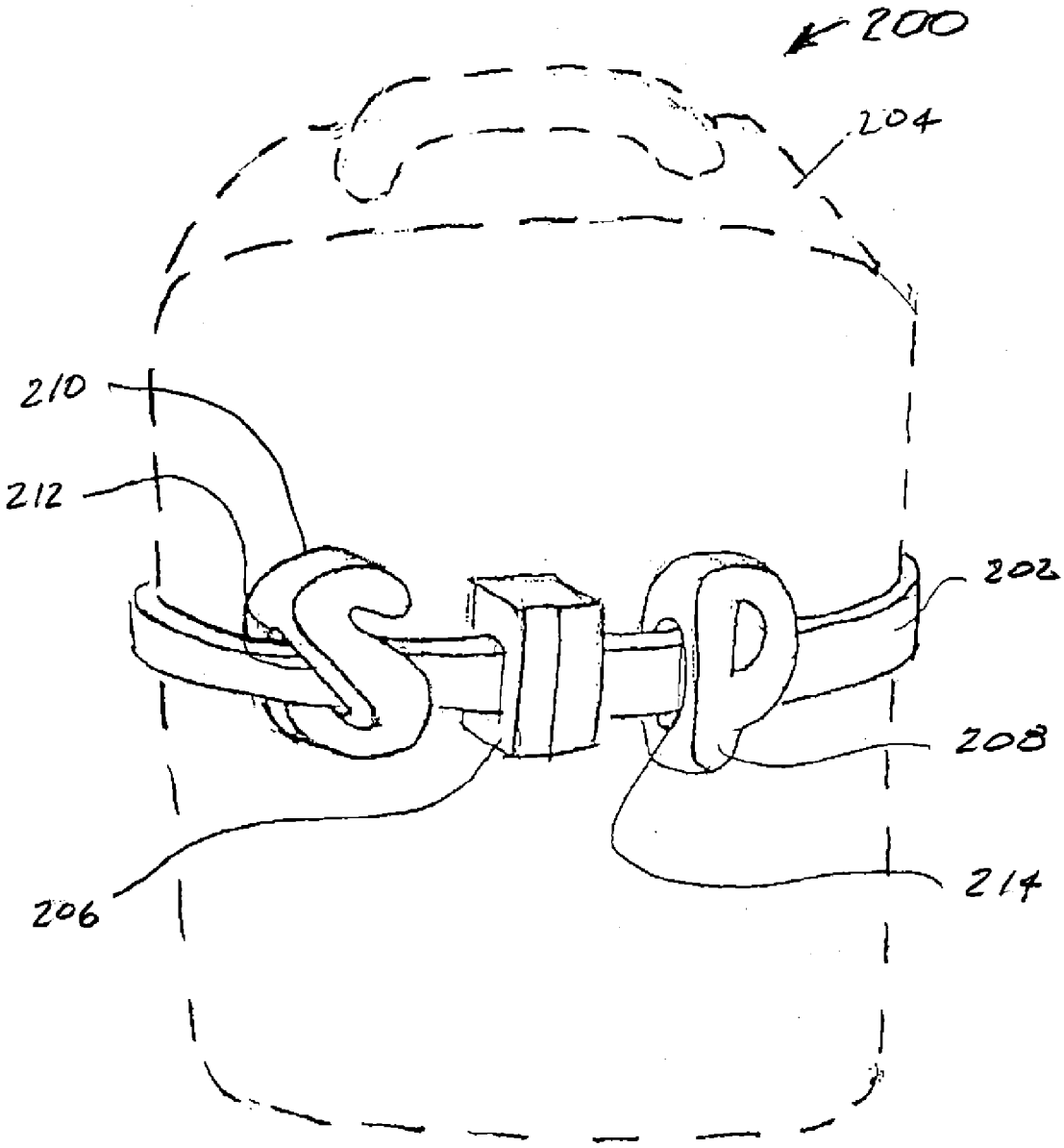
FIG. 7 is an overall perspective view of a third alternative embodiment of the invention.

FIG. 7 shows an embodiment of the luggage tagging system 200 made according to the present invention. As is shown in FIG. 7 the system 200 includes a flexible belt 202 which encircles the luggage 204 and a buckle 206 which tightens the belt 202 and a pair of tags 208, 210.

The tags 208, 210 in FIG. 7 have the general outlines of the capital letters S and P. Any letters desired, or any shape desired may be used. A slot 212, 214 is formed in each of the tags 208, 210 and the belt 202 passes through the slots 212, 214 thereby securing the tags 208, 210 into the belt 202.

The tags 208, 210 may be provided in the form of various letters enabling a user to individually personalize his or her luggage 204 with his or her initials or name.

Figure 8:
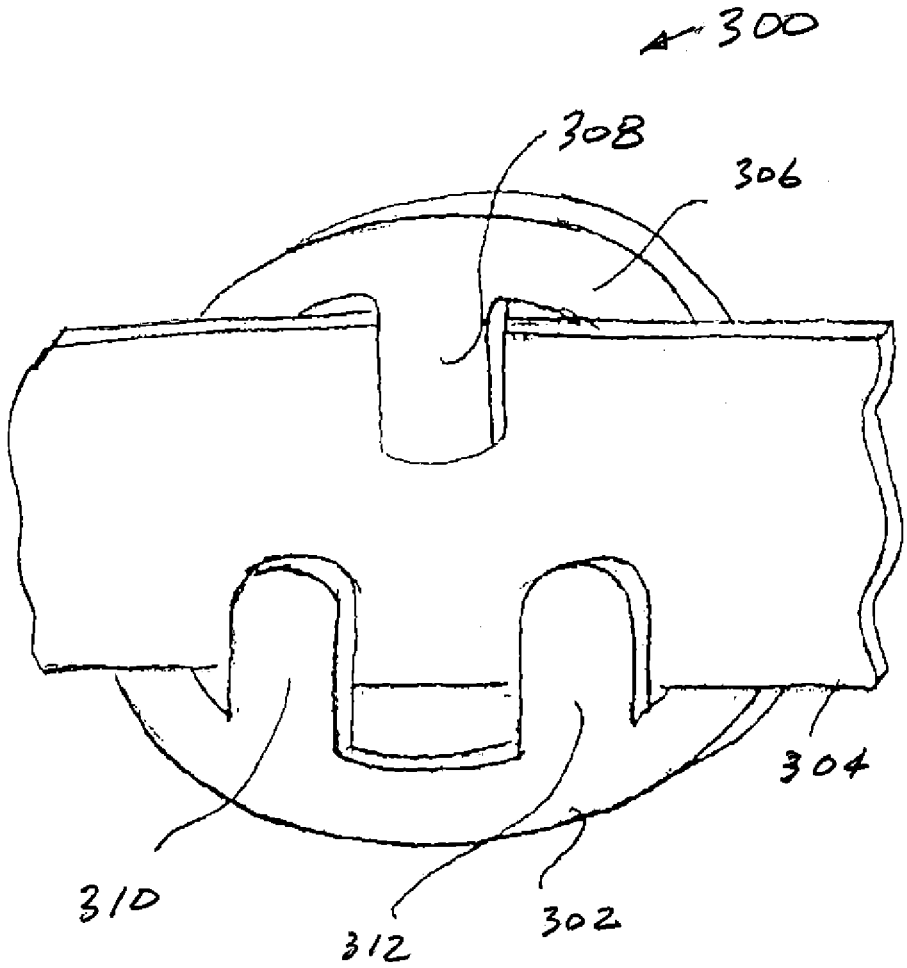
FIG. 8 is a fragmentary rear view of a fourth alternative embodiment of the invention.

FIG. 8 shows an alternative structure 300 for attaching the tag 302 to the belt 304. In FIG. 8, the rear surface 306 of the tag has three projecting flanges or tabs 308, 310, 312 which enable the tag to clip onto the belt 304.

The foregoing specific embodiments of the present invention as set forth in the specifications herein are for illustrative purposes only. Various deviations and modification may be made within the spirit and scope of this invention, without departing from a main theme thereof.

What is claimed is:

1. A luggage tagging system comprising: a flexible elongated belt with said belt having a pair of end portions and an intermediate portion;

a belt connector mounted on said belt for reversible connection of said end portions of said belt;

a luggage tag with luggage comprising:

a first surface;

a second surface on a side opposite the first surface;

a peripheral edge joining the first and second surfaces;

an aperture portion piercing said first and said second surface of said luggage tag for attachment to said luggage using a loop fastener in a conventional manner without the use of a belt;

belt attachment means for removable attachment of said luggage tag on said intermediate portion of said belt; said belt attachment means comprising:

an elongated strap member having a first end and a second end with said first end connected to said first surface of said luggage tag;

a first hook and loop fastener element disposed on said first surface at said first end of said elongated strap member and being on an inward surface of said strap member facing said first surface; and a second hook and loop fastener element disposed on said first surface of said luggage tag and disposed for removable connection to said first hook and loop fastener, with said elongated strap member proportioned to allow said flexible elongated belt to fit between said elongated strap member and said first surface of said luggage tag.

2. The luggage tagging system as claimed in claim 1 further comprising:

a slot portion formed between said first surface and said inward surface with said slot portion proportioned to admit said flexible elongated belt.

3. The luggage tagging system as claimed in claim 1 wherein said peripheral edge has a non-circular configuration.

4. The luggage tagging system as claimed in claim 1 wherein said peripheral edge defines a plurality of lobe portions.

5. The luggage tagging system as claimed in claim 1 wherein said peripheral edge has a generally circular configuration.

6. The luggage tagging system as claimed in claim 1 wherein said peripheral edge defines a letter of the alphabet.

7. The luggage tagging system as claimed in claim 1 wherein said second surface of said luggage tag farther comprises indicia.

8. A luggage tag comprising:

a first surface;

a second surface on a side opposite the first surface;

a peripheral edge joining the first and second surfaces;

an aperture portion piercing said first and said second surface of said luggage tag for attachment to luggage using a loop fastener in a conventional manner without the use of a belt;

a belt attachment which is removably attachable to luggage and comprises:

an elongated strap member having a first end and a second end with said first end connecting to said first surface of said luggage tag;

a first hook and loop fastener element disposed at said first end of said elongated strap member and being on an inward surface of said strap member facing said first surface; and a second hook and loop fastener element disposed on said first surface of said luggage tag and disposed for removable connection to said first hook and loop fastener, with said elongated strap member proportioned to allow a flexible elongated element of a piece of luggage to fit between said elongated strap member and said first surface of said luggage tag.

9. The luggage tag as claimed in claim 8 further comprising:

a slot portion formed between said first surface and said inward surface with said slot portion proportioned to admit a flexible elongated belt.

10. The luggage tag as claimed in claim 8 wherein, said peripheral edge has a non-circular configuration.

11. The luggage tag as claimed in claim 8 wherein said peripheral edge defines a plurality of lobe portions.

12. The luggage tag as claimed in claim 8 wherein said peripheral edge has a generally circular configuration.

13. The luggage tag as claimed in claim 8 wherein said peripheral edge defines a letter of the alphabet.

14. The luggage tag as claimed in claim 8 wherein said second surface further comprises indicia.

* * * * *